US010041722B2

(12) United States Patent
Shin et al.

(10) Patent No.: US 10,041,722 B2
(45) Date of Patent: Aug. 7, 2018

(54) AIR CONDITIONER HAVING A COOLING UNIT ADJACENT THE BLOWER AND THE DISCHARGE

(71) Applicant: SAMSUNG ELECTRONICS CO., LTD., Suwon-si, Gyeonggi-do (KR)

(72) Inventors: Moon Sun Shin, Suwon-si (KR); Jae Youn Cho, Suwon-si (KR); Jin Gyun Kim, Seongnam-si (KR); Yeon Seob Yoon, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 491 days.

(21) Appl. No.: 13/973,239

(22) Filed: Aug. 22, 2013

(65) Prior Publication Data

US 2014/0053591 A1 Feb. 27, 2014

(30) Foreign Application Priority Data

Aug. 24, 2012 (KR) ..... 10-2012-0092841

(51) Int. Cl.
*F25D 21/14* (2006.01)
*F24F 13/22* (2006.01)
(Continued)

(52) U.S. Cl.
CPC ..... *F25D 21/14* (2013.01); *F24F 1/0007* (2013.01); *F24F 1/0033* (2013.01); *F24F 13/20* (2013.01);
(Continued)

(58) Field of Classification Search
CPC ..... F24F 1/0033; F24F 2001/004; F24F 1/02; F24F 1/0014; F24F 1/0011; F24F 2013/205
See application file for complete search history.

(56) References Cited

U.S. PATENT DOCUMENTS 4,171,937 A * 10/1979 Greenfield ..... H02K 5/24 165/122
4,202,409 A * 5/1980 Cann ..... F24F 1/14 165/122
(Continued)

FOREIGN PATENT DOCUMENTS

CN 1629547 6/2005
CN 101749793 6/2010
(Continued)

OTHER PUBLICATIONS

Korean Notice of Allowance dated Aug. 17, 2015 in corresponding Korean Patent Application No. 10-2012-0092841.
(Continued)

*Primary Examiner* — Ned Landrum
*Assistant Examiner* — Filip Zec
(74) *Attorney, Agent, or Firm* — Staas & Halsey LLP

(57) ABSTRACT

An air conditioner includes a housing including a front panel provided with at least one opening, and a rear lower panel disposed at a rear side of the front panel, at least one discharge outlet exposed to a front of the front panel through the opening, at least one suction inlet formed in the housing, at least one heat exchanger to exchange heat with external air through the suction inlet, at least mixed-flow fan rotatably disposed between the heat exchanger and the discharge outlet to suction the air having exchanged heat with the heat exchanger and discharge the air through the discharge outlet, and a drain panel disposed at a lower portion of the heat exchanger to collect condensate produced during heat exchange, and integrated with the rear panel through injection molding.

9 Claims, 10 Drawing Sheets

(51) Int. Cl.
*F24F 1/00* (2011.01)
*F24F 13/20* (2006.01)

(52) U.S. Cl.
CPC ..... *F24F 13/222* (2013.01); *F24F 2001/004* (2013.01); *F24F 2013/205* (2013.01)

(56) References Cited

U.S. PATENT DOCUMENTS

| | | | | | |
|---|---|---|---|---|---|
| 4,382,369 | A * | 5/1983 | Stocking | F24F 1/02 | 62/280 |
| 5,131,560 | A * | 7/1992 | Sullivan | F24F 1/0007 | 220/571 |
| 6,135,402 | A * | 10/2000 | Hatano | F24F 13/32 | 248/205.1 |
| 6,168,517 | B1 * | 1/2001 | Cook | F24F 7/007 | 454/269 |
| 6,460,365 | B2 * | 10/2002 | Kim | F24F 1/0007 | 165/54 |
| 7,003,972 | B2 * | 2/2006 | Eom | F24F 1/0007 | 62/285 |
| 7,275,388 | B2 * | 10/2007 | Joo | F24F 1/0011 | 62/285 |
| 7,607,251 | B2 * | 10/2009 | Kim | F24F 1/0007 | 40/711 |
| 7,752,862 | B2 * | 7/2010 | Bae | F24F 1/0007 | 165/122 |
| 2005/0086963 | A1 * | 4/2005 | Lee | F24F 1/0007 | 62/259.1 |
| 2005/0109053 | A1 | 5/2005 | Eom et al. | | |
| 2007/0169496 | A1 * | 7/2007 | Rios | F24F 13/222 | 62/285 |
| 2008/0160902 | A1 * | 7/2008 | Desler | F24F 1/0007 | 454/251 |
| 2009/0114377 | A1 * | 5/2009 | Zheng | F24F 1/0007 | 165/126 |

FOREIGN PATENT DOCUMENTS

| | | |
|---|---|---|
| JP | 2001-289459 | 10/2001 |
| KR | 10-2007-0078258 | 7/2007 |
| KR | 10-2007-0078261 | 7/2007 |
| KR | 10-2007-0082235 | 8/2007 |
| KR | 10-2007-0099803 | 10/2007 |
| KR | 10-2007-0100019 | 10/2007 |
| KR | 10-2008-0026293 | 3/2008 |
| KR | 20-2009-0001193 | 2/2009 |
| KR | 10-2010-0047684 | 5/2010 |
| KR | 10-2012-0034446 | 4/2012 |

OTHER PUBLICATIONS

Korean Office Action dated Oct. 8, 2014 in corresponding Korean Patent Application No. 10-2012-0092841.
Chinese Office Action dated Mar. 21, 2016 from Chinese Patent Application No. 201310371352.3, 16 pages.
Korean Office Action dated Mar. 3, 2016 from Korean Patent Application No. 10-2015-0107260, 7 pages.
Korean Notice of Allowance dated Nov. 4, 2015 in related Korean Application No. 10-2015-0018579.
Chinese Office Action dated Oct. 8, 2016 from Chinese Patent Application No. 201310371352.3, 13 pages.
Chinese Office Action dated Apr. 17, 2017 in related Chinese Patent Application No. 201310371352.3.
Chinese Decision on Grant dated Aug. 30, 2017 in related Chinese Application No. 201310371352.

* cited by examiner

AIR CONDITIONER HAVING A COOLING UNIT ADJACENT THE BLOWER AND THE DISCHARGE

CROSS-REFERENCE TO RELATED APPLICATIONS

This application claims the benefit of Korean Patent Application No. 10-2012-0092841, filed on Aug. 24, 2012 in the Korean Intellectual Property Office, the disclosure of which is incorporated herein by reference.

BACKGROUND

1. Field

Embodiments of the present disclosure relate to an air conditioner having improved structures of a rear panel and a drain panel.

2. Description of the Related Art

An air conditioner, which generally uses a refrigeration cycle to adjust temperature, humidity, flow and distribution of ambient air to levels proper for human activities and remove dust from the air, includes a compressor, a condenser, an evaporator and a blower fan as the main components of the refrigeration cycle.

Air conditioners may be divided into a split type air conditioner, which has an indoor unit and an outdoor unit separately installed, and an integrated type air conditioner, which has an indoor unit and an outdoor unit installed together in a cabinet.

The indoor unit of the split type air conditioner is provided with a heat exchanger to exchange heat with air suctioned into a panel, and a blower fan to suction the indoor air into the panel and blow the same to the room.

For the split type air conditioner, a blower fan is generally disposed at the lower portion of the indoor unit, and a heat exchanger and an air discharge outlet allowing air to be discharged therethrough are disposed at the upper portion of the indoor unit. The air suctioned and blown by the blower fan moves to the upper portion of the indoor unit, passes the heat exchanger and the air discharge outlet, and is then discharged to the room.

To operate the indoor unit of a split type air conditioner, a drain panel to collect condensate produced at the heat exchanger is needed. In conventional cases, the housing and the drain panel have been separately prepared and combined for the indoor unit.

In this case, separate molds need to be fabricated and managed, and a member to support the drain panel may need to be additionally provided, thereby increasing the amount of materials used to fabricate the indoor unit.

SUMMARY

Therefore, it is an aspect of the present disclosure to provide an air conditioner that allows reduction of the numbers of molds and components by integrating a housing and drain panel of the air conditioner.

It is another aspect of the present disclosure to provide an air conditioner realizing a lightweight product by eliminating a redundant member.

Additional aspects of the disclosure will be set forth in part in the description which follows and, in part, will be apparent from the description, or may be learned by practice of the disclosure.

In accordance with one aspect of the present disclosure, an air conditioner includes a housing including a front panel provided with at least one opening, and a rear lower panel disposed at a rear side of the front panel, at least one discharge outlet exposed to a front of the front panel through the opening, at least one suction inlet formed in the housing, at least one heat exchanger to exchange heat with external air through the suction inlet, at least mixed-flow fan rotatably disposed between the heat exchanger and the discharge outlet to suction the air having exchanged heat with the heat exchanger and discharge the air through the discharge outlet, and a drain panel disposed at a lower portion of the heat exchanger to collect condensate produced during heat exchange, and integrated with the rear panel through injection molding.

One side of the drain panel may be provided with a condensate discharge outlet to drain the condensate collected in the drain panel.

The drain panel may include a fixing member to fix the lower portion of the heat exchanger.

The air conditioner may further include a support member disposed to vertically extend between the drain panel and a lower portion of the rear panel to prevent distortion of the rear lower panel.

The air conditioner may further include a drain hole arranged at a central portion of a lower end of the rear lower panel to discharge the condensate from the condensate discharge outlet to an outside through a drainpipe, wherein the drain hole may be formed in an oblong shape to vertically confine the drainpipe and allow the drainpipe to be disposed at a left side or right side of the drain hole.

The discharge outlet, the mixed-flow fan, the heat exchanger, and the suction inlet may be arranged in a row in a front-to-back direction of the housing.

At least two of the at least one mixed-flow fans may be disposed spaced apart from each other in a vertical direction of the air conditioner.

The air conditioner may further include a diffuser disposed at a front side of the mixed-flow fan, wherein the diffuser may include a circular disc plate, and a circular grille coupled to an outer circumferential surface of the disc plate to form the discharge outlet between the grille and the disc plate.

The air conditioner may further include a drive motor coupled to a rear surface of the disc plate, a rotating shaft of the drive motor being directed toward the suction inlet, wherein the mixed-flow fan may include a hub coupled to the rotating shaft of the drive motor, and a plurality of blades coupled to an outer circumferential surface of the hub.

A flow passage may be formed in the mixed-flow fan such that the suctioned air is slantingly discharged with respect to a central axis of the hub.

The discharge outlet may be formed in a ring shape.

In accordance with another aspect of the present disclosure, an air conditioner includes a housing including a front panel provided with an opening, a rear panel disposed at a rear side of the front panel, and a suction inlet to suction air, a heat exchanger disposed at a front side of the suction inlet to exchange heat with the air through the suction inlet, a mixed-flow fan unit including a discharge outlet exposed to a front of the front panel through the opening, and a mixed-flow fan rotatably disposed between the heat exchanger and the discharge outlet to suction the air having exchanged heat with the heat exchanger and discharge the air through the discharge outlet, and disposed at a front side of the heat exchanger, and a drain panel arranged to fix a lower portion of the heat exchanger to collect condensate produced during heat exchange and protrude inward from the rear panel.

One side of the drain panel may be provided with a condensate discharge outlet to drain the condensate collected in the drain panel.

The air conditioner may further include a fixing member to fix the lower portion of the heat exchanger, the fixing member being provided at an upper portion of the drain panel.

The air conditioner may further include a support member disposed to vertically extend between the drain panel and a lower portion of the rear lower panel to prevent distortion of the rear lower panel.

The air conditioner may further include a drain hole provided arranged at a central portion of a lower end of the rear lower panel to discharge the condensate from the condensate discharge outlet to an outside through a drainpipe, wherein the drain hole is formed in an oblong shape to vertically confine the drainpipe and allow the drainpipe to be disposed at a left side or right side of the drain hole.

The discharge outlet, the mixed-flow fan, the heat exchanger, and the suction inlet may be arranged in a row in a front-to-back direction.

The air conditioner may further include a diffuser disposed at a front side of the mixed-flow fan, wherein the diffuser may include a circular disc plate, and a grille coupled to an outer circumferential surface of the disc plate to form the discharge outlet between the grille and the disc plate.

The air conditioner may further include a drive motor coupled to a rear surface of the disc plate, a rotating shaft of the drive motor being directed toward the suction inlet, wherein the mixed-flow fan may include a hub coupled to the rotating shaft of the drive motor, and a plurality of blades coupled to an outer circumferential surface of the hub.

A flow passage may be formed in the mixed-flow fan such that the suctioned air is slantingly discharged with respect to a central axis of the hub.

The discharge outlet may be formed in a ring shape.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
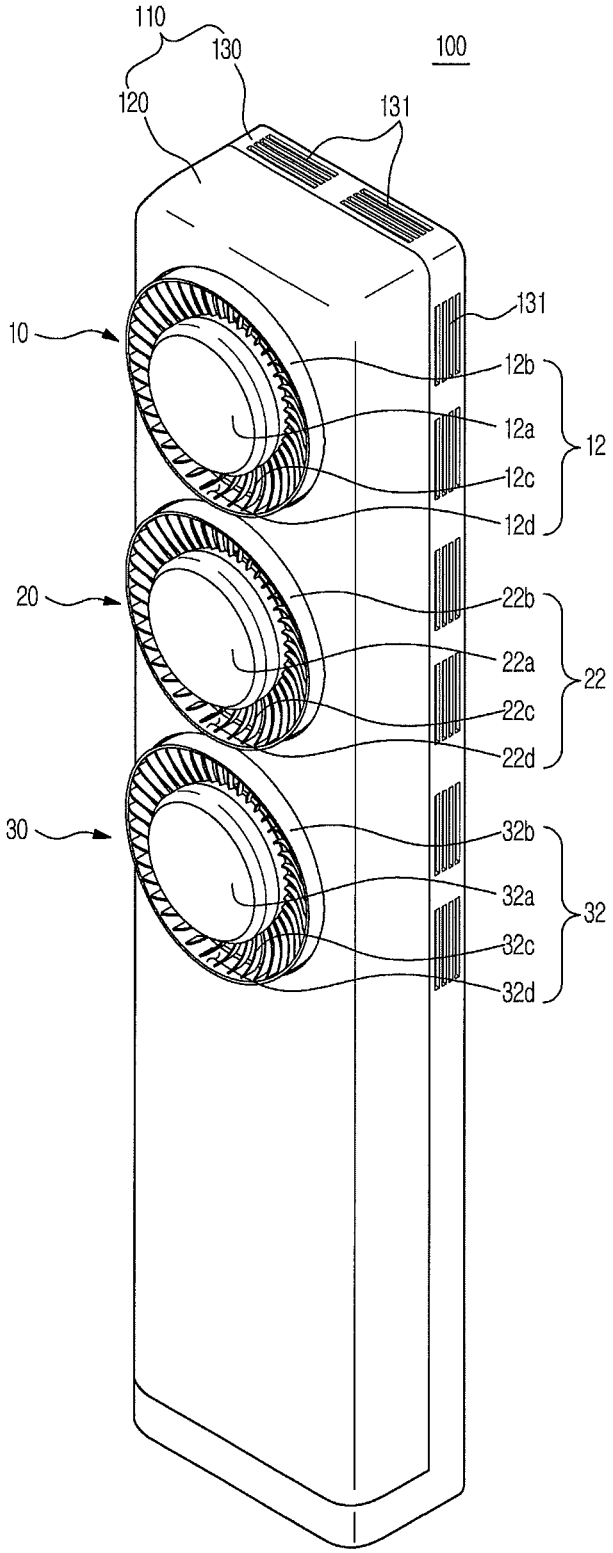
FIG. 1 is a perspective view illustrating an air conditioner according to an exemplary embodiment of the present disclosure.

Reference will now be made in detail to the embodiments of the present disclosure, examples of which are illustrated in the accompanying drawings, wherein like reference numerals refer to like elements throughout.

Figure 2:
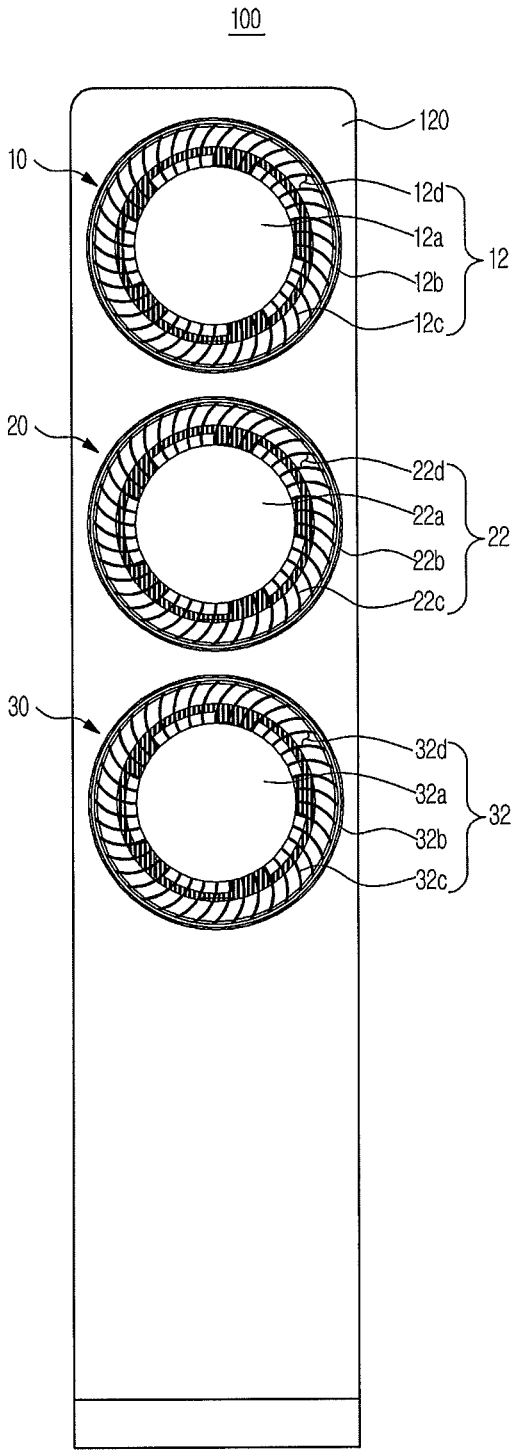
FIG. 2 is a front view illustrating the air conditioner according to the exemplary embodiment of the present disclosure.
Figure 3:
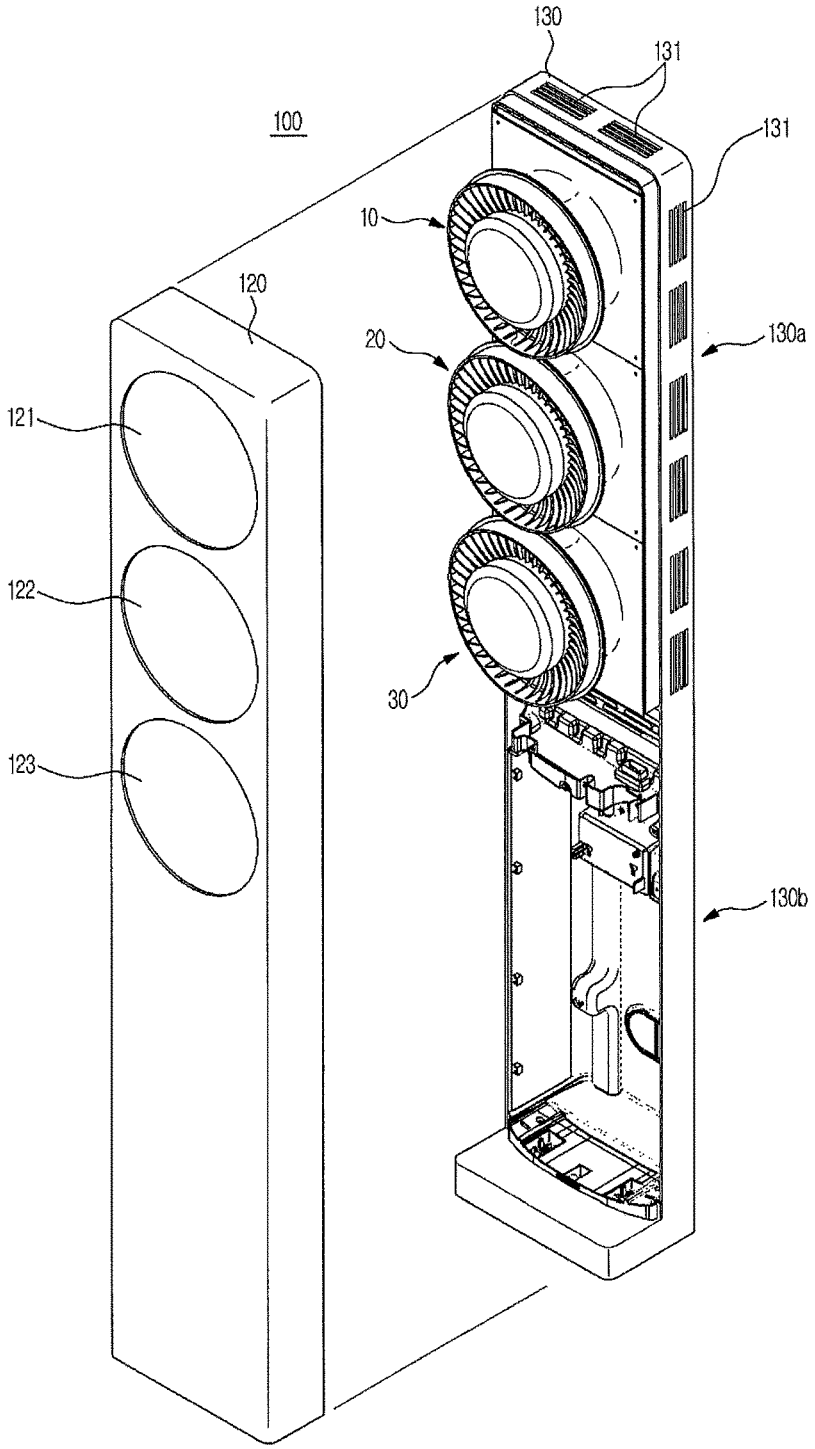
FIG. 3 is an exploded perspective view illustrating the air conditioner according to the exemplary embodiment of the present disclosure.
Figure 4:
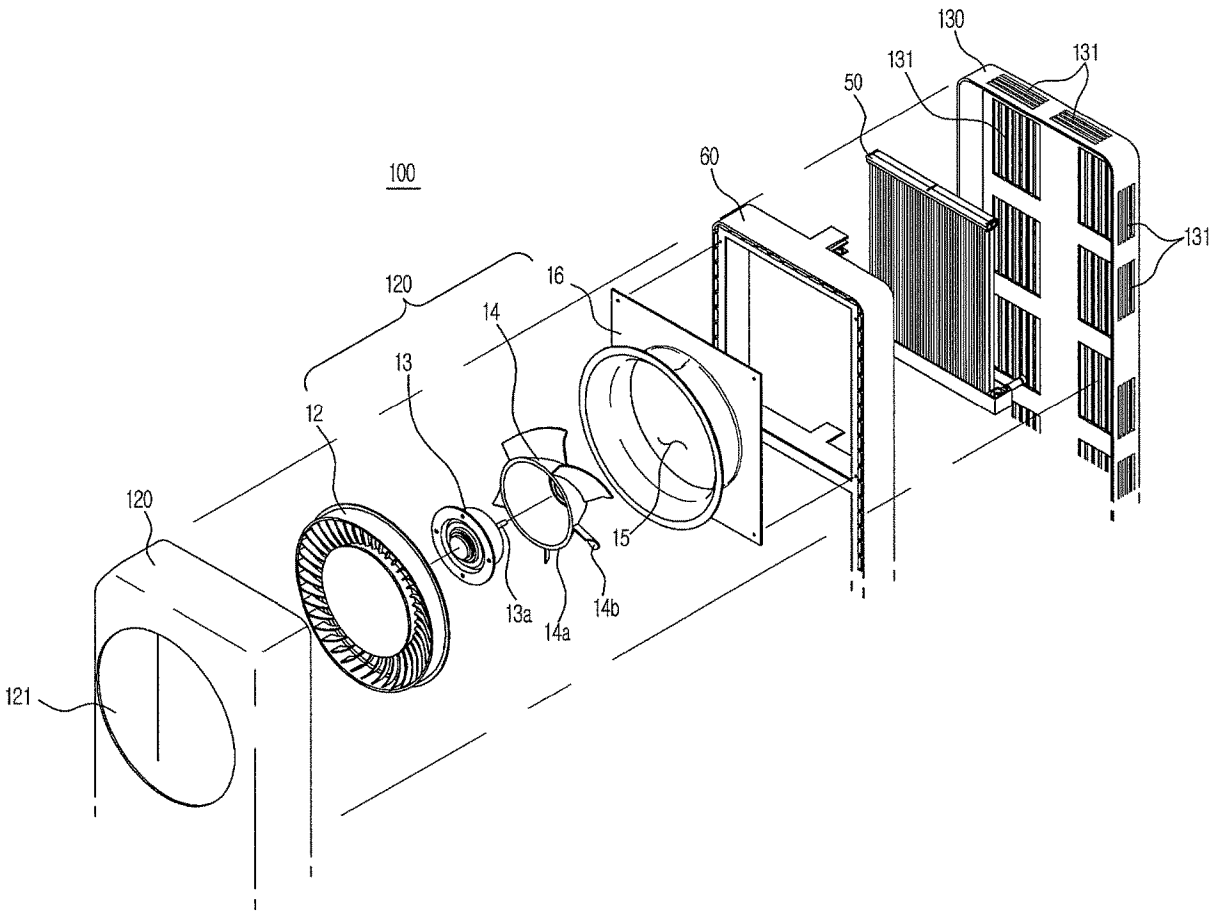
FIG. 4 is an exploded perspective view illustrating the air conditioner according to the exemplary embodiment of the present disclosure.
Figure 5:
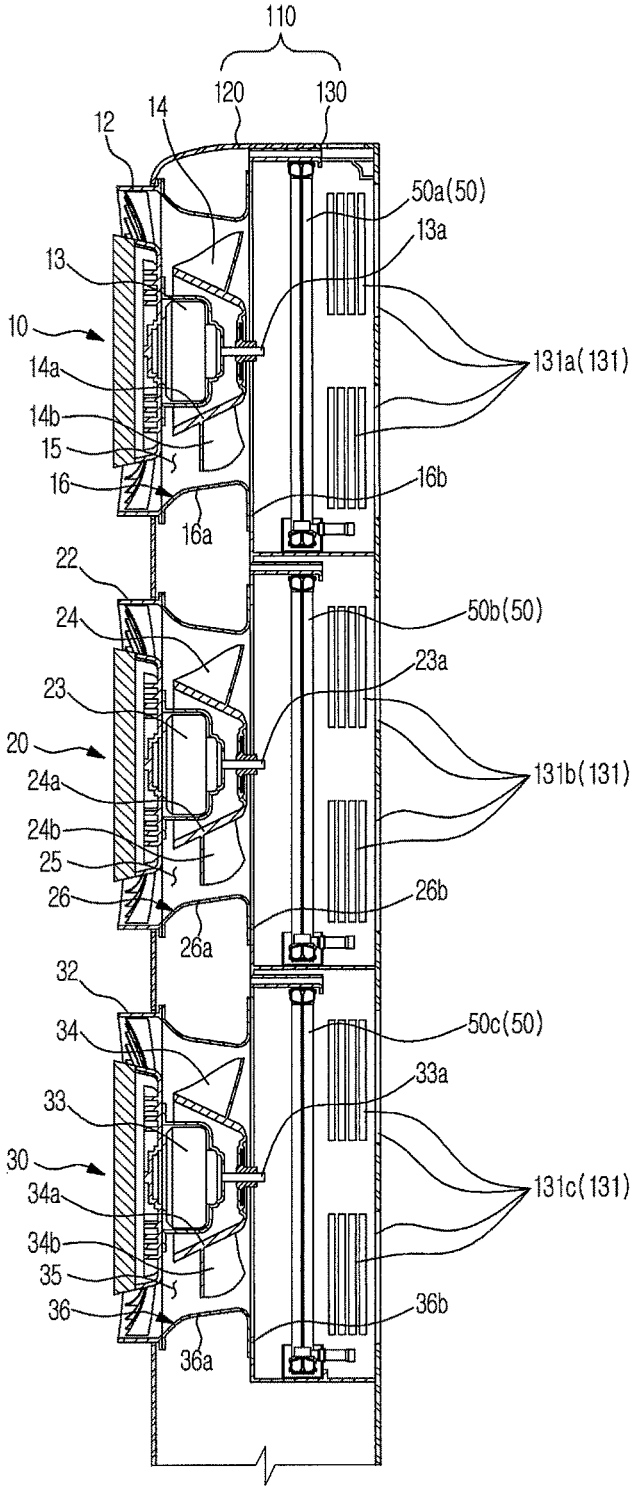
FIG. 5 is a cross-sectional view illustrating the air conditioner according to the exemplary embodiment of the present disclosure.
Figure 6:
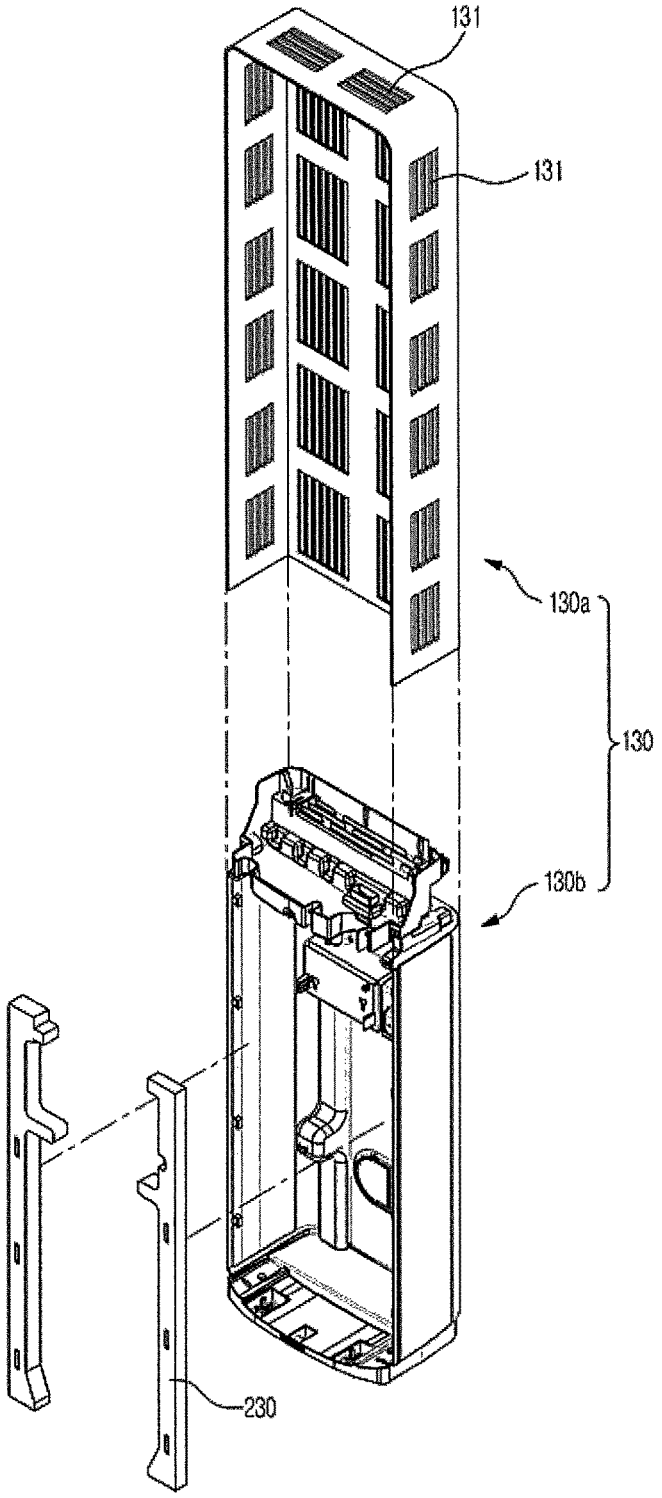
FIG. 6 is a perspective view illustrating a rear panel of the air conditioner according to the exemplary embodiment of the present disclosure.

FIG. 1 is a perspective view illustrating an air conditioner according to an exemplary embodiment of the present disclosure, FIG. 2 is a front view illustrating the air conditioner according to the exemplary embodiment of the present disclosure, FIG. 3 is an exploded perspective view illustrating the air conditioner according to the exemplary embodiment of the present disclosure, FIG. 4 is an exploded perspective view illustrating the air conditioner according to the exemplary embodiment of the present disclosure, FIG. 5 is a cross-sectional view illustrating the air conditioner according to the exemplary embodiment of the present disclosure, and FIG. 6 is a perspective view illustrating a rear panel of the air conditioner according to the exemplary embodiment of the present disclosure.

As shown in FIGS. 1 to 6, the indoor unit 100 of an air conditioner according to the illustrated embodiment of the present disclosure includes a housing 110 including a front panel 120 provided with at least one opening 121, 122 and 123 and a rear panel 130 disposed at the rear side of the front panel 120, at least one discharge outlet 12*d*, 22*d*, 32*d* exposed to the front of the front panel 120 through the at least one opening 121, 122 and 123, at least one suction inlet 131 formed in the housing 110, at least one heat exchanger 50 disposed at the front side of the suction inlet 131 to perform heat exchange through the suction inlet 131, at least one mixed-flow fan 14, 24, 34 rotatably disposed between the heat exchanger 50 and the discharge outlet 12*d*, 22*d*, 32*d* to suction the air having exchanged heat with the heat exchanger 50 and discharge the air through the discharge outlet 12*d*, 22*d*, 32*d*, and a drain panel 200 disposed at the lower portion of the heat exchanger 50 to collect condensate produced during heat exchange, and integrated with the rear panel 130 through injection molding.

Depending on the number of discharge outlets, at least one mixed-flow fan unit, at least one heat exchanger, at least one suction inlet, at least one diffuser, at least one drive motor and at least one duct may be provided. In the illustrated embodiment, the case of having three discharge outlets is described as an example of the air conditioner having at least one discharge outlet.

The housing 110 includes a front panel 120 provided with a plurality of openings 121, 122 and 123 allowing the discharge outlets 12*d*, 22*d*, 32*d* of the mixed-flow fan units 10, 20, 30 to be exposed to the outside in front thereof, and a rear panel 130 coupled to the rear side of the front panel 120. The openings 121, 122 and 123 are formed in a circular shape, and at least two thereof may be disposed spaced apart from each other in a vertical direction of the front panel 120.

The mixed-flow fan unit 10, 20, 30 includes a diffuser 12, 22, 32 forming a discharge outlet 12*d*, 22*d*, 32*d*, a drive motor 13, 23, 33 coupled to the rear surface of the diffuser 12, 22, 32, a mixed-flow fan 14, 24, 34 rotatably coupled to the drive motor 13, 23, 33, and a duct 16, 26, 36 coupled to the rear surfaces of the diffuser 12, 22, 32 to form a flow passage 15, 25, 35 allowing the air suctioned by the mixed-flow fan 14, 24, 34 to move therethrough to be discharged through the discharge outlet 12*d*, 22*d*, 32*d*.

The diffuser 12, 22, 32 includes a circular disc plate 12*a*, 22*a*, 32*a*, a circular grille 12*b*, 22*b*, 32*b* coupled to the outer circumferential surface of the disc plate 12*a*, 22*a*, 32*a*, and a ring-shaped discharge outlet 12*d*, 22*d*, 32*d* formed between the disc plate 12*a*, 22*a*, 32*a* and the grille 12*b*, 22*b*, 32*b*. The diffuser 12, 22, 32 is disposed at the front side of the mixed-flow fan 14, 24, 34, allowing the air from the mixed-flow fan 14, 24, 34 to be discharged forward from the front panel 120 through the discharge outlet 12*d*, 22*d*, 32*d*.

The grille 12*b*, 22*b* and 32*b* includes blade plates 12*c*, 22*c*, 32*c*, and the flow direction and flow rate of the air discharged through the discharge outlet 12*d*, 22*d*, 32*d* may be adjusted by changing the number, shape and orientation of the blade plates 12*c*, 22*c* and 32*c*.

In addition, the flow direction and flow rate of the air discharged through the discharge outlet 12*d*, 22*d*, 32*d* may also be adjusted by widening or narrowing the radial width of the discharge outlet 12*d*, 22*d*, 32*d* through adjustment of the distance between the disc plate 12*a*, 22*a*, 32*a* and the grille 12*b*, 22*b*, 32*b*, or by changing the diameter of the disc plate 12*a*, 22*a*, 32*a*.

The drive motor 13, 23, 33 is coupled to the rear surface of the disc plate 12*a*, 22*a*, 32*a*, with the rotating shaft 13*a*, 23*a*, 33*a* thereof facing the rear panel 130, to rotate the mixed-flow fan 14, 24, 34.

The mixed-flow fan 14, 24, 34, which is disposed between the diffuser 12, 22, 32 and the heat exchanger 50 to suction the air which has exchanged heat with the heat exchanger 50 and discharge the same to the discharge outlet 12*d*, 22*d*, 32*d*, includes a hub 14*a*, 24*a*, 34*a* coupled to the rotating shaft 13*a*, 23*a*, 33*a* of the drive motor 13, 23, 33, and a plurality of blades 14*b*, 24*b*, 34*b* coupled to the outer circumferential surface of the hub 14*a*, 24*a*, 34*a*.

The diameter of the hub 14*a*, 24*a*, 34*a* gradually decreases in a direction toward the rotating shaft 13*a*, 23*a*, 33*a* of the drive motor 13, 23, 33, i.e., toward the rear panel 130, and thereby the outer circumferential surface of the hub 14*a*, 24*a*, 34*a* is formed to be inclined. The outer circumferential surface is inclined such that the air suctioned by the mixed-flow fan 14, 24, 34 is discharged toward the discharge outlet 12*d*, 22*d*, 32*d*.

At least three of the blades 14*b*, 24*b*, 34*b* are disposed equally spaced apart along the outer circumferential surface of the hub 14*a*, 24*a*, 34*a*. When rotating together with the hub 14*a*, 24*a*, 34*a*, the blades 14*b*, 24*b*, 34*b* form a pressure gradient from the front side of the mixed-flow fan 14, 24, 34 to the rear side thereof to produce uniform air flow.

The duct 16, 26, 36 includes a flow passage forming duct 16*a*, 26*a*, 36*a* formed in a circular shape to surround the mixed-flow fan 14, 24, 34 and define a flow passage for the air suctioned by the mixed-flow fan 14, 24, 34 to flow to the discharge outlet 12*d*, 22*d*, 32*d* and a fixing plate 16*b*, 26*b*, 36*b* connected to the rear side of the flow passage forming duct 16*a*, 26*a*, 36*a* to fix the duct 16, 26, 36 to the inside of the housing 110.

The lateral surface of the flow passage forming duct 16*a*, 26*a*, 36*a* is inclined to allow the air suctioned by the mixed-flow fan 14, 24, 34 and the hub 14*a*, 24*a*, 34*a* to be slantingly discharged toward the discharge outlet 12*d*, 22*d*, 32*d*.

The diffuser 12, 22, 32 is coupled and fixed to the front surface of the inlet of the flow passage forming duct 16*a*, 26*a*, 36*a*, and the duct 16, 26, 36 is coupled and fixed to a fixing frame 60 through a fixing plate 16*b*, 26*b*, 36*b* formed in a rectangular shape.

The heat exchanger 50 is disposed between the mixed-flow fan unit 10, 20, 30 and the suction inlet 131 to absorb heat from the air introduced through the suction inlet 131 or transfer heat to the air introduced through the suction inlet 131. The heat exchanger 50 includes a tube 51 and headers 51, the headers 51 being coupled to the upper and lower sides of the tube 51.

One or more heat exchangers 50 may be disposed in the indoor unit 100. That is, a plurality of the heat exchangers 50 may be provided corresponding to the number of the mixed-flow fan units 10, 20 and 30 and disposed respectively at the rear sides of the mixed-flow fan unit 10, 20 and 30, or a single heat exchanger 50 having a size corresponding to the entire size of all the mixed-flow fan units 10, 20 and 30 may be provided. In addition, heat exchange capacities of the heat exchangers 50 may not be equal to each other. That is, one of the heat exchangers 50 having a relatively low heat exchange capacity may be disposed at the rear side of a corresponding one of the mixed-flow fan units 10, 20 and 30, while another one of the heat exchangers 50 having a relatively large heat exchange capacity may be disposed at the rear sides of two or more corresponding mixed-flow fan units 10, 20 and 30.

The suction inlet 131 is arranged on the rear panel 130 disposed at the rear side of the heat exchanger 50 to guide the air outside the indoor unit 100 to be introduced into the indoor unit 100.

As in the case of the heat exchangers 50, one or more suction inlets 131 may be provided on the rear panel 130. To correspond to the respective mixed-flow fan units 10, 20 and 30, the suction inlets 131 corresponding in number to the number of the mixed-flow fan units 10, 20 and 30 may be provided on the rear panel 130, or a single suction inlet 131 corresponding to the entire size of the mixed-flow fan units 10, 20 and 30 may be provided on the rear panel 130. The suction inlets 131 may have different sizes. That is, one of the suction inlets 131 may be disposed at the rear side of a corresponding one of the mixed-flow fan units 10, 20 and 30, while another one of the suction inlets 140 may be disposed at the rear sides of at least two corresponding ones of the mixed-flow fan units 10, 20 and 30.

The air introduced into the housing 110 through the suction inlet 131 absorbs or loses heat while passing through the heat exchanger 50. The air having exchanged heat passing the heat exchanger 50 is suctioned by the mixed-flow fan 14, 24, 34 and discharged to the outside of the housing 110 via the duct 16, 26, 36 and the discharge outlet 12*d*, 22*d*, 32*d*.

When the mixed-flow fan units 10, 20 and 30 are vertically aligned, flows of air suctioned into the suction inlets 131 and discharged through the mixed-flow fan units 10, 20 and 30 may interfere with each other, lowering discharge efficiency.

Therefore, at least one of the mixed-flow fan units 10, 20 and 30 may be formed to have a different diameter than the others to minimize the amount of discharged air and interference between the flows of the discharged air, thereby increasing discharge efficiency.

The mixed-flow fan unit 10, 20, 30 includes a diffuser 12, 22, 32 to form the discharge outlet 12*d*, 22*d*, 32*d*, a drive motor 13, 23, 33 coupled to the rear surface of the diffuser 12, 22, 32, a mixed-flow fan 14, 24, 34 rotatably coupled to the drive motor 13, 23, 33, and a duct 16, 26, 36 coupled to the rear surface of the diffuser 12, 22, 32 to form a flow passage 15, 25, 35 allowing the air suctioned by the mixed-flow fan 14, 24, 34 to move therethrough to be discharged through the discharge outlet 12*d*, 22*d*, 32*d*. The discharge outlet 12*d*, 22*d*, 32*d*, the diffuser 12, 22, 32, the drive motor 13, 23, 33, the mixed-flow fan 14, 24, 34 and the duct 16, 26, 36 included in at least one of the mixed-flow fan units 10, 20 and 30 may be formed to have different diameters. Thereby, interaction and interference between the flows of the air discharged from the mixed-flow fan units 10, 20 and 30 may be minimized, and thus the discharge performance and efficiency may be enhanced.

The plurality of mixed-flow fan units 10, 20 and 30 includes a first mixed-flow fan unit 10, a second mixed-flow fan unit 20 and a third mixed-flow fan unit 30, which are disposed spaced apart from each other in the longitudinal direction of the indoor unit 100. The plurality of heat exchangers 50 includes a first heat exchanger 50*a*, a second heat exchanger 50*b* and a third heat exchanger 50*c*, which are disposed spaced apart from each other between the mixed-flow fan units 10, 20 and 30 and the suction inlets 131 in the longitudinal direction of the indoor unit 100. The plurality of suction inlets 131 includes a first suction inlet 131*a*, a second suction inlet 131*b* and a third suction inlet 131*c* disposed at the rear side of the heat exchangers 50, spaced apart from each other in the longitudinal direction of the indoor unit 100.

The first mixed-flow fan unit 10, the first heat exchanger 50*a* and the first suction inlet 131*a* are arranged in a row. The second mixed-flow fan unit 20, the second heat exchanger 50*b* and the second suction inlet 131*b* are arranged in a row under the first mixed-flow fan unit 10, the first heat exchanger 50*a* and the first suction inlet 131*a*. The third mixed-flow fan unit 30, the third heat exchanger 50*c* and the third suction inlet 131*c* are arranged in a row under the second mixed-flow fan unit 20, the second heat exchanger 50*b* and the second suction inlet 131*b*.

As the mixed-flow fan units 10, 20 and 30, the heat exchangers 50, and the suction inlets 131 respectively disposed at the upper, middle and lower portions of the indoor unit 100 in the longitudinal direction of the indoor unit 100 are arranged in horizontal rows, the indoor unit 100 may have a slim width. In addition, as the flow passage 15, 25, 35 formed between the suction inlet 131 and the discharge outlet 12*d*, 22*d*, 32*d* is short, the operational efficiency of the indoor unit 100 may be increased, while noise level may be lowered.

Figure 7:
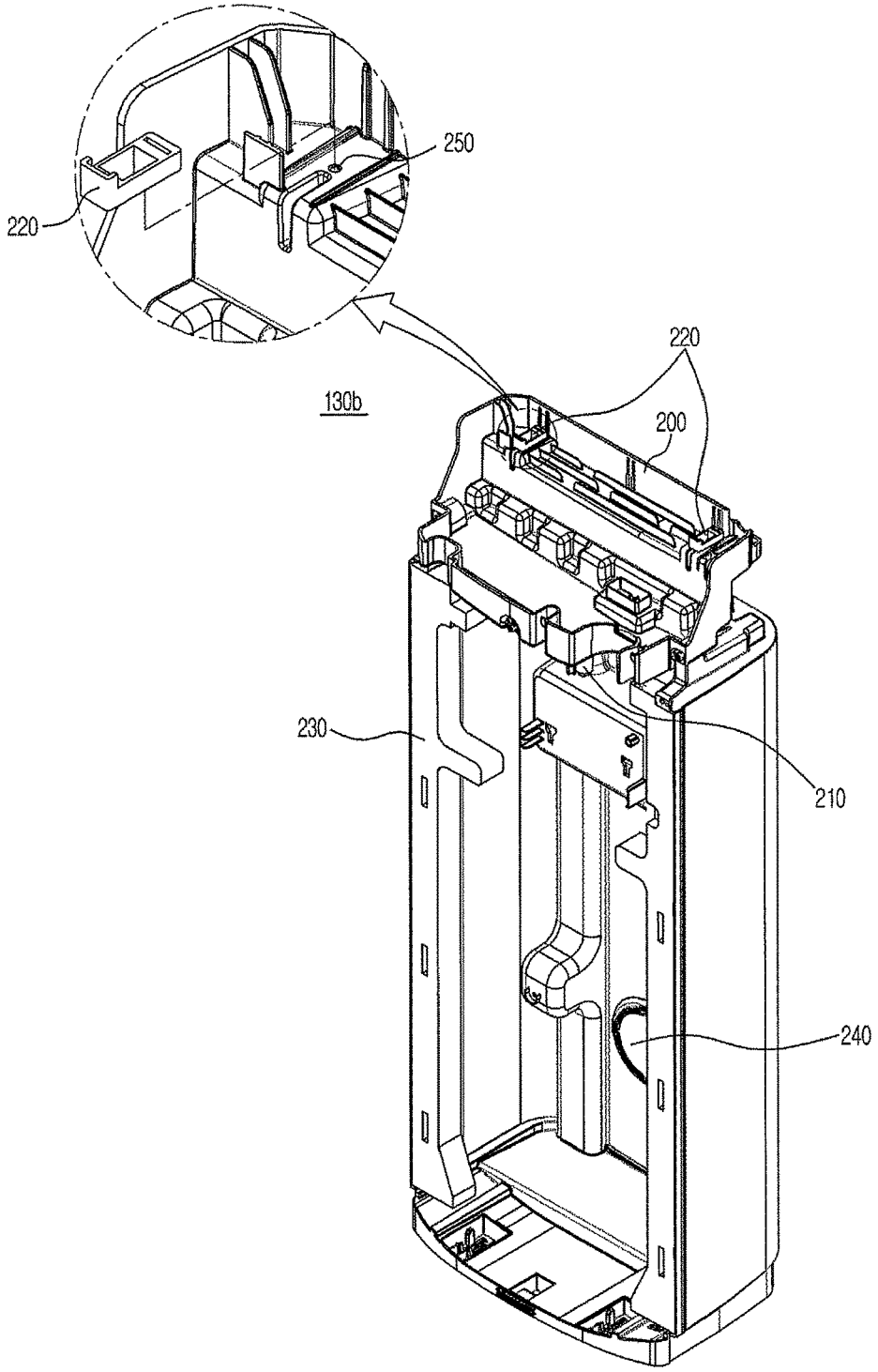
FIG. 7 is a perspective view illustrating a rear lower panel of the air conditioner according to the exemplary embodiment of the present disclosure.
Figure 8:
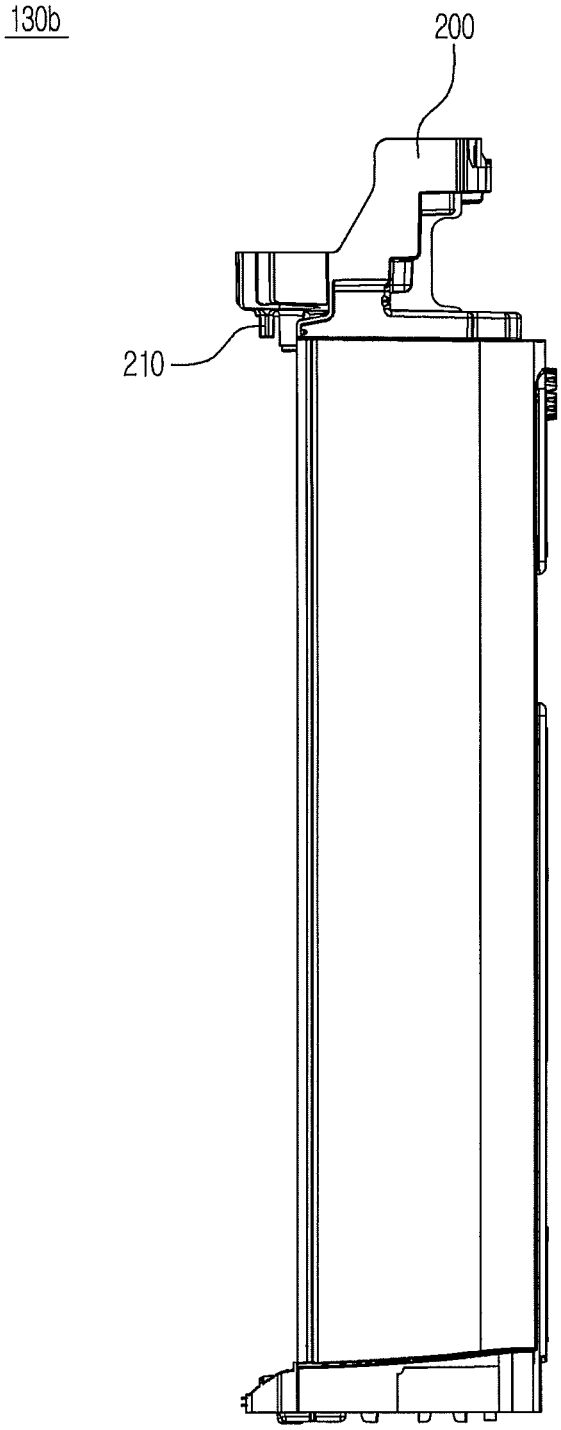
FIG. 8 is a side view illustrating the rear lower panel of the air conditioner according to the exemplary embodiment of the present disclosure.
Figure 9:
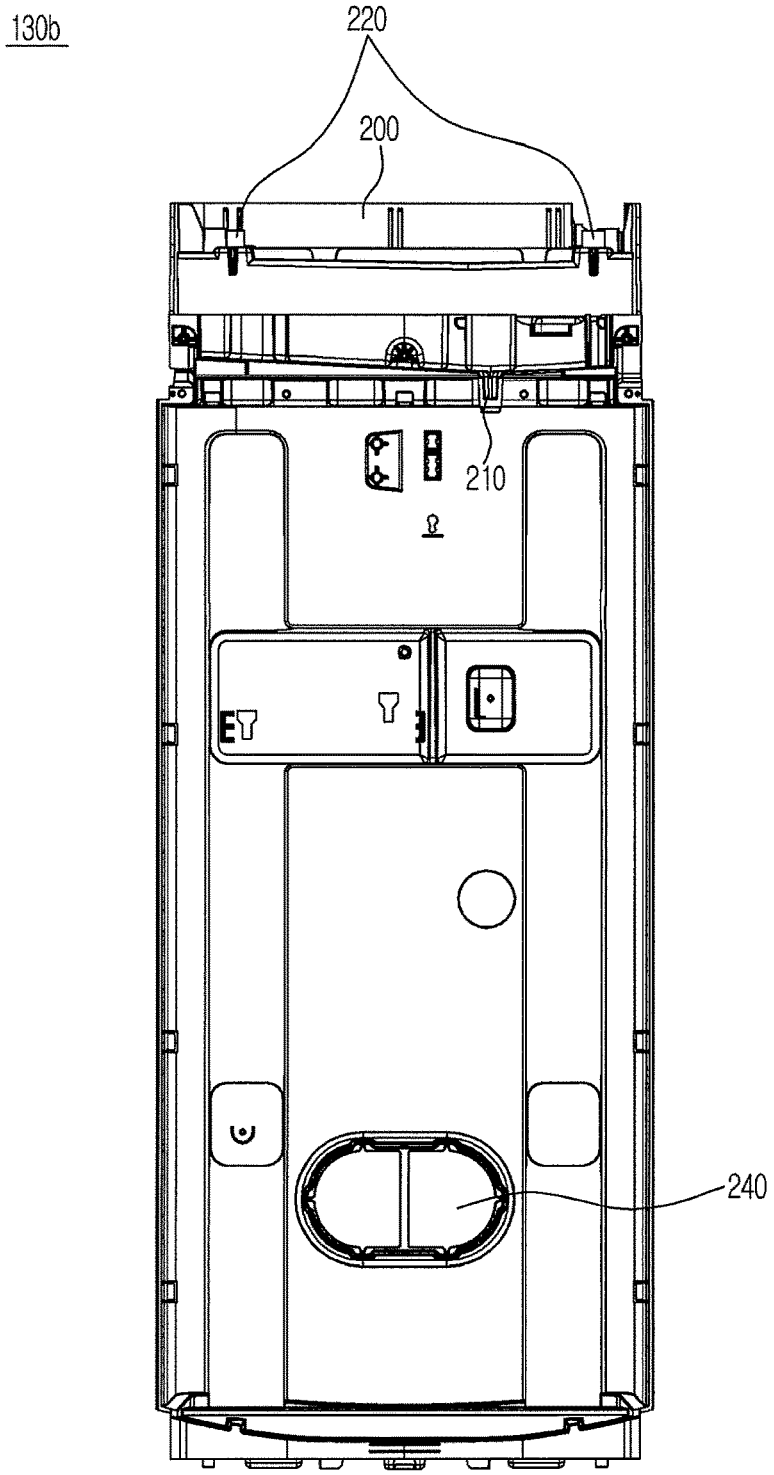
FIGS. 9 and 10 are front views illustrating the rear lower panel of the air conditioner according to the exemplary embodiment of the present disclosure.
Figure 10:
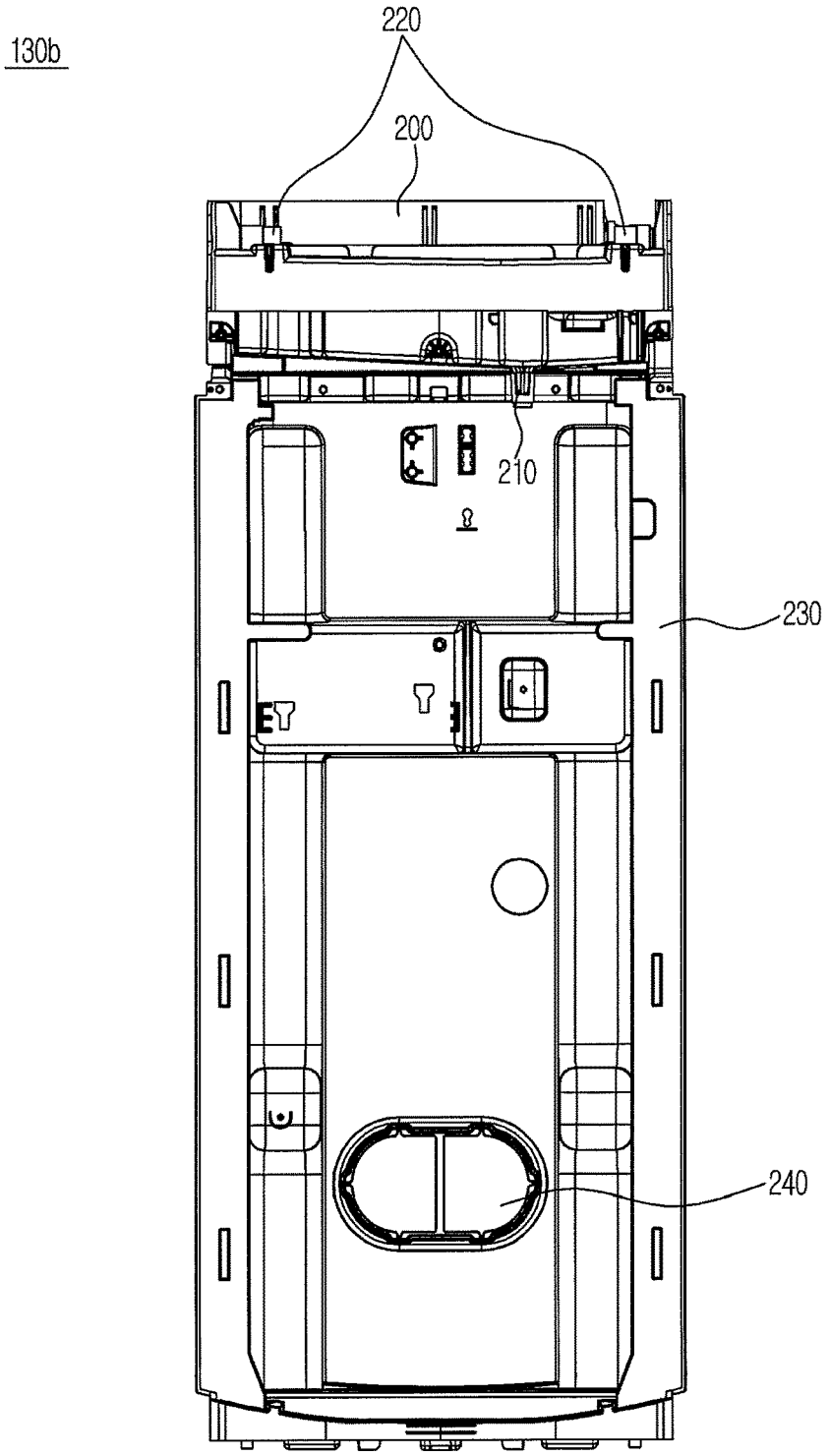

FIG. 7 is a perspective view illustrating a rear lower panel of the air conditioner according to the exemplary embodiment of the present disclosure, FIG. 8 is a side view illustrating the rear lower panel of the air conditioner according to the exemplary embodiment of the present disclosure, and FIGS. 9 and 10 are front views illustrating the rear lower panel of the air conditioner according to the exemplary embodiment of the present disclosure.

A drain panel 200 is disposed on the rear panel 130. More specifically, the drain panel 200 is disposed at the lower portion of the heat exchanger 50 arranged at the front of the suction inlet 131. The drain panel 200 is adapted to collect condensate produced during heat exchange and protrudes inward from the rear panel 130.

A separate member for the drain panel 200 may be provided and coupled to the rear panel 130. In the illustrated embodiment, a part of the rear panel 130 protrudes inward from the rear panel 130 to form the drain panel 200. Through this configuration, a drain panel 200 and the rear panel 130 may be fabricated together through an injection molding process, eliminating the need of a separate injection molding process.

The rear panel 130 includes a rear upper panel 130*a* and a rear lower panel 130*b*. The heat exchanger 50 is disposed at the front surface of the rear upper panel 130*a*, and the suction inlet 131 is disposed at the rear upper panel 130*a* to allow external air to flow to the heat exchanger 50.

The drain panel 200 may be disposed at the rear lower panel 130*b* of the rear panel 130. The rear lower panel 130*b* may be integrated with the drain panel 200 through injection molding and disposed at the upper end of the rear lower panel 130*b* as a part of the rear lower panel 130*b*.

A condensate discharge outlet 210 is provided on one side of the drain panel 200 to drain the condensate produced at the heat exchanger 50 and collected in the drain panel 200. The condensate discharge outlet 210 may be formed in the shape of a tube protruding and extending from the lower portion of the drain panel 200 or in the form of a funnel arrange such that one side thereof having a relatively wide inlet is arranged to the drain panel 200 and the other side thereof forms a relatively narrow outlet. Embodiments of the present disclosure are not limited thereto. The condensate discharge outlet 210 may be formed in any shape that allows the condensate collected in the drain panel 200 to be discharged.

The heat exchanger 50 is disposed at the upper end of the drain panel 200. To fix the heat exchanger 50 to the drain panel 200, the upper end of the drain panel 200 is provide with a fixing member 220. The fixing member 220 may be formed in the shape of a bracket to surround both sides of the heat exchanger 50, or may be formed in an embossed shape to allow the heat exchanger 50 to be seated therein. A fixing member seating portion 250 is provided at the upper end of the drain panel 200 such that the fixing member 220 may be easily replaced according to the capacity of the heat exchanger 50. By fixing the heat exchanger 50 as above, the condensate produced at the heat exchanger 50 may be stably guided to the drain panel 200.

A support member may be further provided to vertically extend between the drain panel 200 disposed at the upper end of the rear lower panel 130*b* and the lower portion of the rear lower panel 130*b* to prevent distortion of the rear panel 130. The support member is disposed near the opening of the rear lower panel 130*b* and between the drain panel 200 and the rear lower panel 130*b* to support the rear lower panel 130*b*. In conventional cases, the drain panel 200 is provided separately from the rear panel 130, and thus a separate support member and the drain panel 200 are coupled to the inside, or the rear panel 130 is formed to have high rigidity to enhance durability. In the illustrated embodiment, the drain panel 200 and the rear lower panel 130*b* are integrated, and thereby a larger inner space is secured, and thus the durability of the indoor unit 100 may be more easily enhanced through coupling of the support member 230.

The condensate discharge outlet 210 provided at the drain panel 200 extends to the outside through a drainpipe. The drainpipe is connected to the outside through a drain hole 240 arranged in the rear panel 130. The drain hole 240 is disposed at the center of the lower end of the rear panel 130. The drain hole 240 may alternatively be disposed at one side of the lower end rather than the center thereof. Arrangement of the drain hole 240 at the center of the lower end of the rear panel 130 may allow the drainpipe not to be exposed to the outside when the indoor unit 100 is installed, thereby contributing to the aesthetics of the external appearance. The drain hole 240 may be formed in an oblong shape to vertically confine the drainpipe and allow the pipe to be placed at the left side or right side thereof to extend. More specifically, the drain hole 240 may have a width allowing two drainpipes to be placed therein, and may be disposed to allow a drainpipe to extend through one side of the drain hole. Further, a member having the size of one portion of the drain hole 240 may be screw-coupled to one side of the upper end of the drain hole 240 on the rear panel 130 such that it is used to close one portion of the drain hole 240 which is not in use.

An air conditioner according to another embodiment of the present disclosure includes a housing 110 including a front panel 120 provided with at least one opening 121, 122 and 123, a rear panel 130 disposed at the rear side of the front panel 120, and a suction inlet 131 to suction air, a heat exchanger 50 disposed at the front of the suction inlet 131 to exchange heat with the external air through the suction inlet 131, at least one mixed-flow fan unit 10, 20 and 30 including a discharge outlet 12*d*, 22*d*, 32*d* exposed to the front of the front panel through the opening 121, 122, 123, and a mixed-flow fan 14, 24, 34 rotatably disposed between the heat exchanger 50 and the discharge outlet 12*d*, 22*d*, 32*d* to suction the air having exchanged heat with the heat exchanger 50 and discharge the air through the discharge outlet 12*d*, 22*d*, 32*d*, and disposed at the front side of the heat exchanger 50, and a drain panel 200 arranged to fix the lower portion of the heat exchanger 50 to collect condensate produced during heat exchange and protrude inward from the rear panel 130.

The constituents of the illustrated embodiment are the same as those of the previous embodiment and thus a description thereof will be omitted.

As is apparent from the above description, a housing and a drain panel of an air conditioner according to the preset disclosure are integrated, and therefore the number of molds to be fabricated and the components may be reduced. In addition, as a redundant part is eliminated, a finished product may have a light weight and the area of the inner space may be increased, thereby allowing an additional support member to be used to support the housing to provide robust support of the load applied by the upper structural components.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. An air conditioner comprising:

a housing including a front panel having a front surface and side surfaces, the front panel being provided with at least one opening, and a rear panel having a rear surface and side surfaces, the rear panel being joined to a rear side of the front panel at the side surfaces of the front panel and the rear panel;

at least one discharge outlet exposed to a front of the front panel through the at least one opening;

at least one suction inlet formed in the housing;

at least one heat exchanger to exchange heat with external air through the at least one suction inlet, the at least one heat exchanger being disposed at a front surface of a mid portion of the rear panel;

at least one blower fan rotatably disposed between the at least one heat exchanger and the at least one discharge outlet to suction the external air having exchanged heat with the at least one heat exchanger and discharge suctioned external air through the at least one discharge outlet;

a drain panel formed integrally with the rear panel, the drain panel being configured to collect condensate from the at least one heat exchanger produced during heat exchange;

columnar support members formed on left and right sides of a bottom of the drain panel, respectively, the columnar support members vertically extending from the bottom of the drain panel to a bottom portion of the rear panel, whereby distortion of the rear panel is prevented;

a diffuser disposed at a front side of the at least one blower fan, the diffuser comprising a disc plate;

a circular grille coupled to an outer circumferential surface of the disc plate to form the at least one discharge outlet between the circular grille and the disc plate; and a drive motor coupled to a rear surface of the disc plate, a rotating shaft of the drive motor being directed toward the at least one suction inlet, wherein the drain panel comprises a fixing part to fix the lower portion of the at least one heat exchanger.

2. The air conditioner according to claim 1, wherein one side of the drain panel is provided with a condensate discharge outlet to drain the condensate collected in the drain panel.

3. The air conditioner according to claim 2, further comprising a drain hole provided at a central portion of a lower end of the rear panel to discharge the condensate from the condensate discharge outlet outside through a drainpipe, wherein the drain hole is formed in an oblong shape to vertically confine the drainpipe and allow the drainpipe to be disposed at a left side or right side of the drain hole.

4. The air conditioner according to claim 1, wherein the at least one discharge outlet, the the at least one blower fan, the at least one heat exchanger, and the at least one suction inlet are arranged in a row in a front-to-back direction of the housing.

5. The air conditioner according to claim 1, wherein at least two of the at least one blower fan are disposed spaced apart from each other in a vertical direction of the air conditioner.

6. The air conditioner according to claim 1, wherein the at least one blower fan comprises:

a hub coupled to the rotating shaft of the drive motor; and a plurality of blades coupled to an outer circumferential surface of the hub.

7. The air conditioner according to claim 6, wherein a flow passage is formed in the at least one blower fan such that the suctioned external air is slantingly discharged with respect to a central axis of the hub.

8. The air conditioner according to claim 1, wherein the at least one discharge outlet is formed in a ring shape.

9. The air conditioner according to claim 1, wherein the at least one blower fan comprises a mixed-flow fan.

* * * * *